US007124460B2

(12) United States Patent
Lecinq et al.

(10) Patent No.: US 7,124,460 B2
(45) Date of Patent: Oct. 24, 2006

(54) CONSTRUCTION CABLE

(75) Inventors: Benoit Lecinq, Fontenay-Aux-Roses (FR); Jean-Pierre Messein, Villiers les Nancy (FR)

(73) Assignee: Freyssinet International (Stup), Velizy Villacoublay (FR)

( * ) Notice: Subject to any disclaimer, the term of this patent is extended or adjusted under 35 U.S.C. 154(b) by 0 days.

(21) Appl. No.: 10/527,147

(22) PCT Filed: Mar. 24, 2003

(86) PCT No.: PCT/FR03/00921

§ 371 (c)(1),
(2), (4) Date: Mar. 8, 2005

(87) PCT Pub. No.: WO2004/094730

PCT Pub. Date: Nov. 4, 2004

(65) Prior Publication Data

US 2005/0252675 A1 Nov. 17, 2005

(51) Int. Cl.
*E01D 19/14* (2006.01)

(52) U.S. Cl. ..... 14/22; 14/21

(58) Field of Classification Search ..... 14/18–23, 14/78; 52/223.13, 223.14
See application file for complete search history.

(56) References Cited

U.S. PATENT DOCUMENTS

| | | | | |
|---|---|---|---|---|
| 4,068,963 | A | 1/1978 | Brandestini | |
| 4,557,007 | A * | 12/1985 | Daiguji et al. | 14/22 |
| 4,633,540 | A * | 1/1987 | Jungwirth et al. | 14/22 |
| 4,718,965 | A * | 1/1988 | Finsterwalder et al. | 156/294 |
| 5,173,982 | A * | 12/1992 | Lovett et al. | 14/22 |
| 6,301,735 | B1 * | 10/2001 | Jartoux et al. | 14/22 |
| 6,523,207 | B1 * | 2/2003 | Stubler et al. | 14/22 |
| 6,560,807 | B1 * | 5/2003 | Stubler et al. | 14/22 |
| 6,578,329 | B1 * | 6/2003 | Stubler et al. | 52/223.14 |
| 6,658,684 | B1 * | 12/2003 | Stubler et al. | 14/22 |
| 6,715,176 | B1 * | 4/2004 | Stubler et al. | 14/22 |
| 6,748,708 | B1 | 6/2004 | Fuzier et al. | |
| 2002/0028112 | A1 * | 3/2002 | Paulshus et al. | 405/224.2 |
| 2002/0108329 | A1 * | 8/2002 | Bournand et al. | 52/223.13 |
| 2003/0086755 | A1 * | 5/2003 | Stubler et al. | 403/204 |
| 2003/0110583 | A1 * | 6/2003 | Stubler et al. | 14/22 |
| 2004/0111987 | A1 * | 6/2004 | Paulshus et al. | 52/223.13 |

FOREIGN PATENT DOCUMENTS

| | | |
|---|---|---|
| FR | 2340484 | 9/1977 |
| FR | 2592666 | 7/1987 |

(Continued)

*Primary Examiner*—Meredith C. Petravick
*Assistant Examiner*—Alexandra Pechhold
(74) *Attorney, Agent, or Firm*—Banner & Witcoff, Ltd.

(57) ABSTRACT

The cable, in particular of the stay cable type, comprises a set of traction reinforcements, two devices for anchoring the reinforcements in two respective zones of the construction, the reinforcements being spaced apart from one another at the anchoring devices, means for deviating the reinforcements in order to cause the reinforcements to converge toward a running part of the cable into a substantially parallel bundle which is more compact than at the anchoring devices, and a guide member which is in closely set contact around the set of reinforcements. This member has an inner surface, the cross section of which is adapted to the peripheral shape of the parallel bundle and the longitudinal section of which has a convex curvature which, over the length of the guide member, allows angular deflections of the reinforcements which are substantially greater than the maximum angle of convergence of the reinforcements between the anchoring device and the running part of the cable.

51 Claims, 2 Drawing Sheets

FOREIGN PATENT DOCUMENTS

JP 2003147902 A * 5/2003
WO WO0075453 A 12/2000
WO WO 2057560 A1 * 7/2002

* cited by examiner

CONSTRUCTION CABLE

CROSS REFERENCE TO RELATED APPLICATION

This is a national phase application in the U.S. based on international application No. PCT/FR2003/000921 first filed on Mar. 24, 2003 and for which priority is claimed.

BACKGROUND OF THE INVENTION

The present invention relates to the field of cables used in building for participating in the structure of certain civil engineering constructions.

It is aimed more particularly at arrangements of such cables which give them good properties in the event of an earthquake.

The invention is especially applicable to the stay cables used for suspending portions of the construction, such as bridge decks. In a current embodiment, such a stay cable comprises a bundle of parallel reinforcements extending between two anchoring zones, one arranged on a pylon of the construction and the other on the suspended part. In the anchoring zone, the individual reinforcements of the stay cable have a slight divergence, so that they can be locked individually.

When a stayed construction experiences an earthquake, the suspended part, for example the bridge deck, undergoes abrupt and potentially considerable displacements with respect to the pylons. This results in high variations in traction and in flexion in the stay cables.

The flexural stresses are reflected in the anchoring zones and risk damaging the reinforcements and/or the anchoring devices.

The document WO 00/75453 describes an anchoring device for a structure cable, such as a stay cable, provided with guide means comprising an individual guide duct for each reinforcement, this duct widening in the direction of the running part of the cable, so as to allow an angular deviation of the reinforcement. The advantage of this anchoring device is that it ensures a progressive take-up of the flexural forces attributable to the convergence of the reinforcements toward the running part or of some transverse actions experienced by the stay cable. However, this force take-up may prove insufficient in the presence of the violent stress variations undergone in the event of an earthquake.

SUMMARY OF THE INVENTION

An object of the present invention is to propose an arrangement making it possible for the structure cables and for the constructions of which they form part to withstand the high stresses occurring in the event of an earthquake.

The invention thus proposes a civil engineering structure cable, comprising:

- a set of traction reinforcements;
- two devices for anchoring the reinforcements in two respective zones of the construction, the reinforcements being spaced apart from one another at the anchoring devices; and
- means for deviating the reinforcements to cause the reinforcements to converge toward a running part of the cable into a substantially parallel bundle which is more compact than at the anchoring devices.

According to the invention, the structure cable comprises at least one guide member which is in closely set contact around the set of reinforcements and which has an inner surface, the cross section of which is adapted to the peripheral shape of the parallel bundle and the longitudinal section of which has a convex curvature which, over the length of the guide member, allows angular deflections of the reinforcements which are substantially greater than the maximum angle of convergence of the reinforcements between the anchoring device and the running part of the cable.

The form of the guide member allows it absorb high angular deflections of the set of reinforcements, with a controlled radius of curvature in order to avoid damaging the reinforcements and the anchoring device.

In preferred embodiments of the cable according to the invention:

- the angular deflections allowed by the guide member are of at least 100 milliradians;
- the angular deflections allowed by the guide member are at least double the maximum angle of convergence of the reinforcements between the anchoring device and the running part of the cable;
- the radius of curvature of the longitudinal section of the inner surface of the guide member is at least 3 meters in the portion where this member is in closely set contact around the set of reinforcements;
- the radius of curvature of the longitudinal section of the inner surface of the guide member decreases from the portion where the member is in closely set contact around the set of reinforcements toward the running part of the cable;
- the guide member is mounted with a capacity for transverse movement with respect to one of the anchoring devices;
- means for the damping of transverse vibrations of the bundle of reinforcements with respect to one of the anchoring devices are provided, and the guide member is placed on the set of reinforcements between the damping means and said anchoring device;
- the guide member is mounted with a limited capacity for transverse movement with respect to said anchoring device, so as to provide a defined stroke of the damping means;
- the anchoring device bears longitudinally against a tube which is connected to the structure of a part of the construction and through which the reinforcements pass, the damping means comprise a damper arranged between the bundle of reinforcements and a support mounted at that end of said tube which is opposite the anchoring device, and the mounting of the support at the end of the tube is carried out by means of a connection designed to break when it is subjected to a force exceeding a predefined threshold;
- the deviation means comprise a collar clamped around the set of reinforcements at a distance from an anchoring device, and the guide member is placed on the set of reinforcements between said collar and said anchoring device;
- inserts are seated, together with the reinforcements, in the guide member, so as to maintain a spacing between the reinforcements inside the guide member;
- said inserts comprise plastic sleeves placed individually around the reinforcements inside the guide member, the inner surface of the guide member preferably having a hexagonal cross section;
- the guide member belongs to the deviation means, at the same time contributing to causing the reinforcements to converge toward the running part of the cable;

the guide member comprises a body of cast plastic resin around a metal reinforcing tube, and this plastic resin may, in particular, be a polyurethane resin.

Another aspect of the present invention relates to a guide member for a structure cable, as defined above. This member has a tubular general shape, with an inner surface to be applied in closely set contact around a set of traction reinforcements, the set of reinforcements converging between an anchoring device and a running part of the cable where the reinforcements are gathered into a parallel bundle which is more compact than at the anchoring device, said inner surface having a cross section adapted to the peripheral shape of said bundle and a longitudinal section having a convex curvature which, over the length of the guide member, allows angular deflections of the reinforcements which are substantially greater than the maximum angle of convergence of the reinforcements between the anchoring device and the running part of the cable. Said inner surface preferably has a hexagonal or circular cross section.

DESCRIPTION OF PREFERRED EMBODIMENTS

The invention is described below, without this being limiting, with regard to a structure cable consisting of a bridge stay cable.

Figure 1:
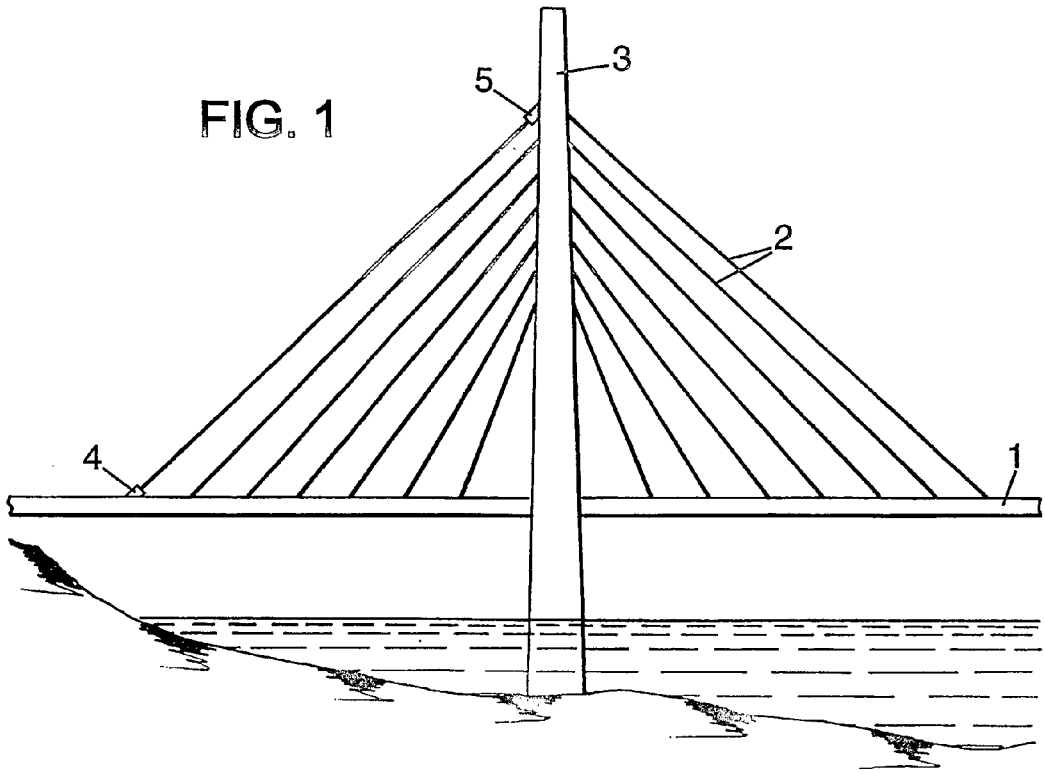
FIG. 1 is a diagrammatic side view of a cable stayed bridge to which the invention may be applied.

A cable stayed bridge is illustrated diagrammatically in FIG. 1. The deck 1 of the bridge is supported by sets of stay cables 2 with one or more pylons 3 erected in the zone through which the bridge passes. Each stay cable 2 follows a defined path between a bottom anchoring device 4 mounted on the deck 1 and a top anchoring device 5 mounted on the pylon 3.

Figure 2:
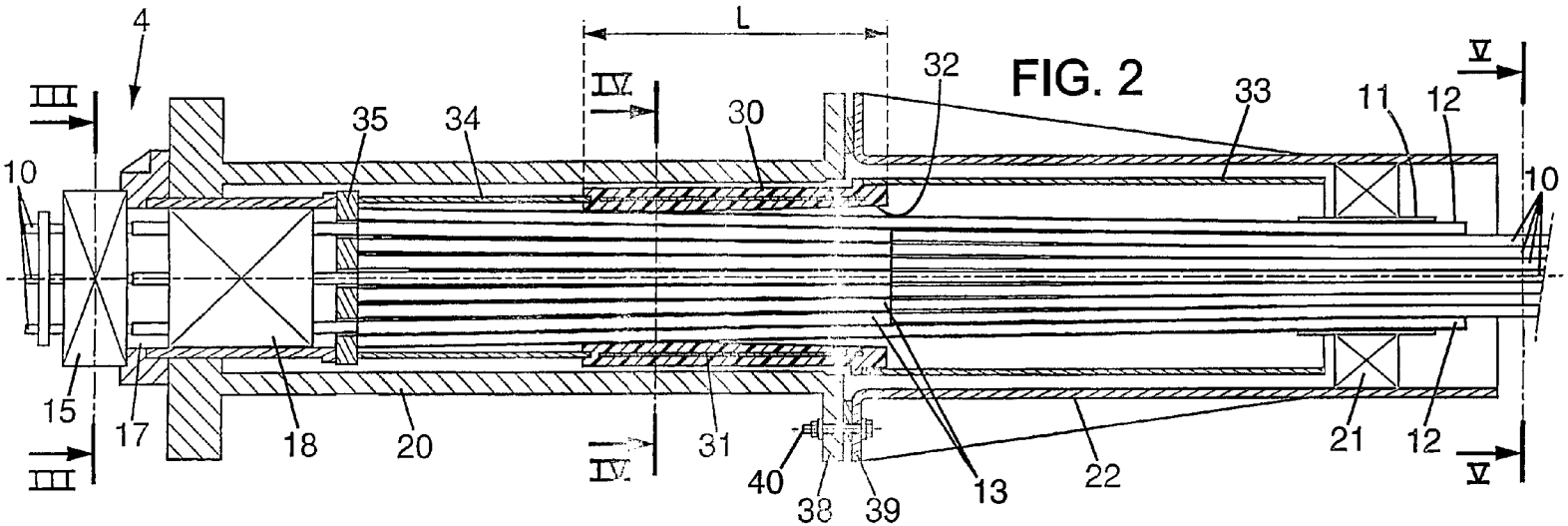
FIG. 2 is a diagrammatic view, in longitudinal section, of a part of a stay cable according to the invention.

FIG. 2 shows in more detail the structure of the stay cable in the deck zone where the anchoring device 4 is located.

Figure 5:
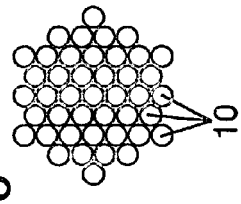
FIG. 3 to 5 are cross-sectional views of this stay cable, taken respectively along the planes Ill—Ill, IV—IV and V—V indicated in FIG. 2.

The stay cable 2 comprises a set of traction reinforcements 10 which, in the example considered, consist of metal strands, each covered with an individual plastic sheath. In the running part of the stay cable, said running part extending over the greatest part of its course between the deck and the pylon, the strands 10 are gathered into a compact parallel bundle. The transverse arrangement of the strands 10 in the running part is, for example, that illustrated in FIG. 5, where there is maximum compactness, since the strands, of circular outer shape, are in contact with one another according to a hexagonal meshwork.

To form this compact bundle of strands, a deviating collar 11, arranged at a distance from the anchoring device 4, is closely set around the set of strands in order to cause them to converge.

Figure 3:
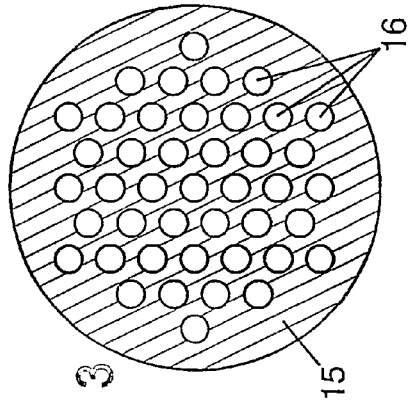

The anchoring device 4 comprises a metal block 15 illustrated in cross section in FIG. 3. The block 15 has crossing through it parallel orifices 16 which are cylindrical towards the running part of the stay cable and are frusto-conical towards the opposite direction. Each orifice 16 receives a stripped strand and an anchoring jaw consisting of a plurality of keys in the form of a sector of a cone frustum. The orifices 16 have some spacing between them, so as to have room to accommodate the anchoring jaws and to obtain a sufficiently robust block. The transverse meshwork of these orifices is homothetic to that of the strands in the running part of the cable. Consequently, the strands converge from the anchoring device 4 toward the running part.

The individual sheath of the strands 10 is interrupted in a chamber 17 at the rear of the anchoring block 15. The residual gaps in the block and the chamber 17 are filled with a corrosion protection material, such as a grease. A sealing system 18, for example of the stuffing box type, as described in European patent 0 323 285, closes the chamber 17 opposite the block 15 by forming a seal around the individual sheaths of the strands 10. The anchoring device 4 may also comprise ducts for the individual guidance of the strands, as described in the document WO 00/75453, which widen in the direction of the running part of the cable, so as to allow an angular deviation of the individual strands.

The anchoring device 4 bears longitudinally against a tube 20 connected to the structure of the deck 1 or of the pylon 3, in order to transmit the tractive force in the stay cable.

The stay cable illustrated in FIG. 2 is equipped with a vibration damping device 21 which is located on the deck side at a distance (a few meters) from the anchoring device 4. This device 21 serves for damping the transverse vibrations of the stay cable 2 with respect to the tube 20 and to the anchoring device 4, which are attributable to the dynamic load variations associated with the traffic on the bridge or with the aerodynamic forces. It is, for example, of the type described in European patent 0 914 521, with an annular chamber contained between the deviation collar 11 and a supporting tube 22 fastened to the end of the tube 20, this chamber containing a viscous material affording the damping effect. Alternatively, the viscous damping device could be mounted on an arm extending transversely between the stay cable and the deck 1 (see European patent 0 343 054).

The stay cable thus equipped has some capacity for allowing overall displacements of the strands with respect to the structure. The lever arm between the exit of the anchoring device 4 and the collar 11 gives the damper 21 a certain transverse stroke which allows angular movements, preferably in conjunction with the ducts for the individual guidance of the strands, said ducts being present at the exit of the anchorage. These angular movements have a limited amplitude, typically to approximately 25 milliradians. Greater deflections would risk damaging the strands by imparting an excessive curvature to them at the anchoring device.

However, the angular deflections occurring in the event of an earthquake may be much higher. In order nonetheless to give the stay cable according to the invention earthquake protection properties, a guide member 30 is installed between the anchoring device 4 and the collar 11 and before the strands 10 are put in place.

Figure 4:
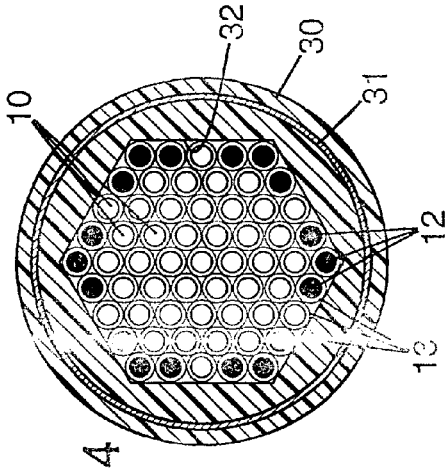

This guide member 30 is of cylindrical general shape. As shown in FIGS. 2 and 4, it may consist of a body of cast plastic resin around a steel reinforcing tube 21. The cast plastic is advantageously a polyurethane resin which has the advantages of being easily castable, thus making it possible for the member 30 to be shaped with great accuracy, of having excellent mechanical resistance properties (hardness, stability to shearing and tensile stresses) and of having good behavior in aggressive marine environments.

The inner surface 32 of the guide member 30 is in closely set contact around the strands, once they are installed. The cross section of this inner surface 32, as can be seen in FIG. 4, is adapted to the peripheral shape of the bundle of parallel strands. In the example illustrated, a hexagonal cross section circumscribes the strands assembled in the form of a hexagonal meshwork. When the strands thus assembled are of a number equal to 1+3n.(n+1), that is to say 7, 19, 37, 61, etc., the compact bundle has a hexagonal outer profile corresponding to n complete concentric layers around a central strand. If the number of strands provided for supporting the load of the stay cable is not one of these values, as in the depicted example where the stay cable has 43 strands (FIG. 5), the bundle is completed by dummy strands 12 within the deviation member 30. These dummy strands 12 may be prolonged as far as the collar 11, beyond which they are interrupted. They are not anchored in the device 4. In the example considered, there are 61−43=18 dummy strands 12, illustrated in black in FIG. 4.

Since the member 30 is located in an intermediate position between the anchorage 4 and the collar 11, the strands 10 have, in the region of said member, a spacing corresponding to a fraction of that which they have in the anchoring block 15. In order to position them accurately, at the same time ensuring good bearing contact on the guide member 30, and to prevent them from becoming disorganized in the event of abrupt flexural stresses, inserts are seated within the member 30 together with the set of strands 10, 12. These inserts may consist of individual plastic sleeves 13, into which that part of the strands 10, 12 which passes through the member 30 is threaded. A stop plate 35 is placed at the back of the anchoring device 4, to prevent this device from being disturbed by the ends of the sleeves 13 or of the dummy strands 12.

If it is not necessary for the strands to have maximum compactness in the running part of the stay cable, the cross section of the inner surface 32 of the guide member 30 may also be circular.

The longitudinal section of the inner surface 32 of the member 30 is illustrated in FIG. 2. It has a convex curvature which, over the length L of the guide member 30, allows angular deflections of the reinforcements which are markedly greater (typically at least two times greater) than the maximum angle of convergence of the strands 10 between the anchorage 4 and the running part of the stay cable. These allowed angular deflections amount, for example, to $\alpha$=100 milliradians or more, whereas the maximum angle of convergence, that is to say that of the peripheral strands, is of the order of 25 milliradians.

This take-up of pronounced angular deflections is carried out with a controlled radius of curvature, in order to avoid excessive flexural stresses on the strands at the exit from the anchorage. This radius of curvature R of the longitudinal section of the inner surface 32 of the member 30 is advantageously at least 3 meters in the rear portion of the member, where it is in closely set contact around the set of strands. In an embodiment with strands having a diameter of 15.7 mm, the radius of curvature R in this rear portion will typically be 4 meters.

This radius of curvature R may be constant over the length L of the member 30. In this case, the angular defection in radians allowed by the member 30 is $\alpha \approx \mathrm{tg}\ \alpha = L/R$. The length L may therefore be of the order of 40 cm for R=4 m and $\alpha$=100 milliradians.

To reduce the overall size of the guide member 30, its inner surface 32 may be formed in such a way that the radius of curvature of its longitudinal section decreases from the rear portion, where the member is in closely set contact around the strands 10, toward the running part of the stay cable. This is possible, without too great a risk of damaging the strands, since the greatest angular deflections in the event of an earthquake tend to occur when the axial stress on the stay cable is not very high: it may thus be assumed that a strand subjected to less axial stress follows a slightly more closely set curvature. The smallest radius of curvature, at the front end of the member 30, is, for example, of the order of 2.5 meters.

In a particularly advantageous embodiment, the guide member 30 is mounted in a floating manner with respect to the anchorage 4. It can thus be seen, in FIG. 2, that the member 30 has a capacity for transverse movement with respect to the tube 20 and to the anchoring device 4. This avoids reducing the stroke available for the functioning of the damper 20 and therefore impairing its dynamic behavior. This capacity for transverse movement of the guide member 30 is limited so as to provide a defined stroke of the damper 21.

The floating guide member 30 is, in principle, held longitudinally, since it is in closely set contact around the set of strands. To prevent it from nevertheless undergoing appreciable displacements, it may be prolonged axially by means of spacers 33, 34, for example of tubular shape, which butt respectively on the damper 21 and on the stop plate 35 in the event of longitudinal movements.

An earthquake gives rise to abrupt variations in moment of flexion in the anchoring zones of the stay cables. These abrupt variations are poorly filtered by the damper 21. This risks resulting in serious damage to the anchoring zone, especially to the tube 20, requiring major repairs, along with the dismantling of the anchorage and even of the stay cable. To limit this risk, there is advantageously provision for the connection between the tube 20 and the support 22 of the damper to be designed to break when said connection is subjected to a force exceeding a predefined threshold.

In the example illustrated in FIG. 2, this connection is made by means of bolts 40 which axially clamp flanges 38, 39 formed respectively at the mutually confronting ends of the tube 20 and of the support 22. The diameter of these bolts 40 is selected so that they break before the transverse force reaches 4% of the axial force, thus limiting the moment of flexion transferred to the tube 20 and allowing the guide member 30 to function under optimum conditions.

The possible break of these bolts 40 is relatively minor, since they are easily replaced.

It will be understood that the exemplary embodiment which has just been described does not limit the scope of the invention and that numerous variants may be made to it. In particular, a guide member 30, as described above, may be located in the region of a top anchorage, toward the pylon. It may, on the other hand, be installed, without any device for damping vibrations on the stay cable.

On the other hand, the guide member 30 may belong to the means for deviating the reinforcements, which ensure that the latter converge into a compact bundle. It may, in particular, be substituted for the collar 11 shown in FIG. 2, if the size constraints in the anchoring zone allow this.

The invention claimed is:

1. A civil engineering structure cable, comprising:

a set of traction reinforcements;

two devices for anchoring the reinforcements in two respective zones of the construction, the reinforcements being spaced apart from one another at the anchoring devices;

means for deviating the reinforcements to cause the reinforcements to converge toward a running part of the cable into a substantially parallel bundle more compact than at the anchoring devices; and at least one guide member in closely set contact around the set of reinforcements in the portion of the cable where the reinforcements converge toward the running part, said guide member having an inner surface presenting a cross section adapted to a peripheral shape of the parallel bundle and a longitudinal section having a convex curvature whereby, over the length of the guide member, said convex curvature allows angular deflections of the reinforcements up to an angle substantially greater than and at least double a maximum angle of convergence of the reinforcements between the anchoring device and the running part of the cable.

2. The structure cable as claimed in claim 1, wherein the angular deflections allowed by the guide member are of at least 100 milliradians.

3. The structure cable as claimed in claim 1 wherein the longitudinal section of the inner surface of the guide member has a radius of curvature of at least 3 meters in a portion where said guide member is in closely set contact around the set of reinforcements.

4. The structure cable as claimed in claim 3, wherein the radius of curvature of the longitudinal section of the inner surface of the guide member decreases from the portion where the member is in closely set contact around the set of reinforcements toward the running part of the cable.

5. The structure cable as claimed in claim 1, wherein the guide member is mounted with a capacity for transverse movement with respect to one of the anchoring devices.

6. The structure cable as claimed in claim 1, further comprising means for damping transverse vibrations of the bundle of reinforcements with respect to one of the anchoring devices, and wherein the guide member is placed on the set of reinforcements between the damping means and said anchoring device.

7. The structure cable as claimed in claim 6, wherein the guide member is mounted with a limited capacity for transverse movement with respect to said anchoring device, so as to provide a defined stroke of the damping means.

8. The structure cable as claimed in claim 6, wherein the anchoring device bears longitudinally against a tube connected to the structure of a part of the construction and having the reinforcements extending then through, wherein the damping means comprise a damper arranged between the bundle of reinforcements and a support mounted at end of said tube opposite the anchoring device, and wherein the support is mounted at the end of the tube by means of a connection designed to break when subjected to a force exceeding a predefined threshold.

9. The structure cable as claimed in claim 1, wherein the deviation means comprise a collar clamped around the set of reinforcements at a distance from an anchoring device, and wherein the guide member is placed on the set of reinforcements between said collar and said anchoring device.

10. The structure cable as claimed in claim 9, wherein inserts are seated, together with the reinforcements, in the guide member, so as to maintain a spacing between the reinforcements inside the guide member.

11. The structure cable as claimed in claim 10, wherein said inserts comprise plastic sleeves placed individually around the reinforcements inside the guide member.

12. The structure cable as claimed in claim 11, wherein the inner surface of the guide member has a hexagonal cross section.

13. The structure cable as claimed in claim 1, wherein the guide member belongs to the deviation means and contribute to causing the reinforcements to converge toward the running part of the cable.

14. The structure cable as claimed in claim 1, wherein the guide member comprises a body of cast plastic resin around a metal reinforcing tube.

15. The structure cable as claimed in claim 14, wherein the plastic resin is a polyurethane resin.

16. A civil engineering cable and anchor construction comprising, in combination:

a cable including at least two cable strands in a bundle having a peripheral shape;

an anchoring device for attachment of the strands;

a collar for maintaining the strands in said peripheral shape and in a compact bundle, said collar spaced a distance from the anchoring device;

said strands forming an angle of convergence between the anchoring device and the collar;

a guide member positioned about the strands intermediate the anchoring device and the collar, said guide member shaped with a tubular inner surface adapted to the peripheral shape of the bundle of strands; and said inner surface of said guide member having a longitudinal section forming a convex curvature over the length of the guide member to allow angular deflection of the strands of at least 100 milliradians and greater than the maximum angle of convergence of the strands between the anchoring device and the collar.

17. The construction of claim 16 wherein the radius of curvature of the length of the inner surface of the guide member decreases from a portion located toward the anchoring device to a portion located toward the collar.

18. A civil engineering structure cable, comprising:

a set of traction reinforcements;

two devices for anchoring the reinforcements in two respective zones of the construction, the reinforcements being spaced apart from one another at the anchoring devices; means for deviating the reinforcements to cause the reinforcements to converge toward a running part of the cable into a substantially parallel bundle more compact than at the anchoring devices;

at least one guide member in closely set contact around the set of reinforcements in the portion of the cable where the reinforcements converge toward the running part, said guide member having an inner surface presenting a cross section adapted to a peripheral shape of the parallel bundle and a longitudinal section having a convex curvature whereby, over the length of the guide member, said convex curvature allows angular deflections of the reinforcements up to an angle of at least 100 milliradians and substantially greater than a maximum angle of convergence of the reinforcements between the anchoring device and the running part of the cable.

19. The structure cable as claimed in claim 18 wherein the longitudinal section of the inner surface of the guide member has a radius of curvature of at least 3 meters in a portion where said guide member is in closely set contact around the set of reinforcements.

20. The structure cable as claimed in claim 19, wherein the radius of curvature of the longitudinal section of the inner surface of the guide member decreases from the portion where the member is in closely set contact around the set of reinforcements toward the running part of the cable.

21. The structure cable as claimed in claim 18, wherein the guide member is mounted with a capacity for transverse movement with respect to one of the anchoring devices.

22. The structure cable as claimed in claim 18, further comprising means for damping transverse vibrations of the bundle of reinforcements with respect to one of the anchoring devices, and wherein the guide member is placed on the set of reinforcements between the damping means and said anchoring device.

23. The structure cable as claimed in claim 22, wherein the guide member is mounted with a limited capacity for transverse movement with respect to said anchoring device, so as to provide a defined stroke of the damping means.

24. The structure cable as claimed in claim 22, wherein the anchoring device bears longitudinally against a tube connected to the structure of a part of the construction and having the reinforcements extending therethrough, wherein the damping means comprise a damper arranged between the bundle of reinforcements and a support mounted at end of said tube opposite the anchoring device, and wherein the support is mounted at the end of the tube by means of a connection designed to break when subjected to a force exceeding a predefined threshold.

25. The structure cable as claimed in claim 18, wherein the deviation means comprise a collar clamped around the set of reinforcements at a distance from an anchoring device, and wherein the guide member is placed on the act of reinforcements between said collar and said anchoring device.

26. The structure cable as claimed in claim 25, wherein inserts are seated, together with the reinforcements, in the guide member, so is to maintain a spacing between the reinforcements inside the guide member.

27. The structure cable as claimed in claim 26, wherein said inserts comprise plastic sleeves placed individually around the reinforcements inside the guide member.

28. The structure cable as claimed in claim 27, wherein the inner surface of the guide member has a hexagonal cross section.

29. The structure cable as claimed in claim 18, wherein the guide member belongs to the deviation means and contribute to causing the reinforcements to converge toward the running part of the cable.

30. The structure cable as claimed in claim 18, wherein the guide member comprises a body of cast plastic resin around a metal reinforcing tube.

31. The structure cable as claimed in claim 30, wherein the plastic resin is a polyurethane resin.

32. A civil engineering structure cable, comprising:

set of traction reinforcements;

two devices for anchoring the reinforcements in two respective zones of the construction, the reinforcements eats being spaced apart from one another at the anchoring devices;

means for deviating the reinforcements to cause the reinforcements to converge coward a running part of the cable into a substantially parallel bundle more compact than at the anchoring devices; and at least one guide member in closely set contact around the set of reinforcements in the portion of the cable where the reinforcements converge toward the running part, said guide member having an inner surface presenting a cross section adapted to a peripheral shape of the parallel bundle and a longitudinal section having a convex curvature whereby, over the length of the guide member, said convex curvature allows angular deflections of the reinforcements up to an angle substantially greater than a maximum angle of convergence of the reinforcements between the anchoring device and the running part of the cable, wherein the longitudinal section of the inner surface of the guide member has a radius of curvature of at least 3 meters in a portion where said guide member is in closely set contact around the set of reinforcements and wherein the radius of curvature of the longitudinal section of the inner surface of the guide member decreases from the portion where the member is in closely set contact around the set of reinforcements toward the running part of the cable.

33. The structure cable as claimed in claim 32, wherein the guide member is mounted with a capacity for transverse movement with respect to one of the anchoring devices.

34. The structure cable as claimed in claim 32, further comprising means for damping transverse vibrations of the bundle of reinforcements with respect to one of the anchoring devices, and wherein the guide member is placed on the set of reinforcements between the damping means and said anchoring device.

35. The structure cable as claimed in claim 34, wherein the guide member is mounted with a limited capacity for transverse movement with respect to said anchoring device, so as to provide a defined stroke of the damping means.

36. The structure cable as claimed in claim 34, wherein the anchoring device bears longitudinally against a tube connected to the structure of a part of the construction and having the reinforcements extending therethrough, wherein the damping means comprise a damper arranged between the bundle of reinforcements and a support mounted at end of said tube opposite the anchoring device, and wherein the support is mounted at the end of the tube by means of a connection designed to break when subjected to a force exceeding a predefined threshold.

37. The structure cable as claimed in claim 32, wherein the deviation means comprise a collar clamped around the set of reinforcements at a distance from an anchoring device, and wherein the guide member is placed on the set of reinforcements between said collar and said anchoring device.

38. The structure cable as claimed in claim 37, wherein inserts are seated, together with the reinforcements, in the guide member, so as to maintain a spacing between the reinforcements inside the guide member.

39. The structure cable as claimed in claim 38, wherein said inserts comprise plastic sleeves placed individually around the reinforcements inside the guide member.

40. The structure cable as claimed in claim 39, wherein the inner surface of the guide member has a hexagonal cross section.

41. The structure cable as claimed in claim 32, wherein the guide member belongs to the deviation means and contribute to causing the reinforcements to converge toward the running part of the cable.

42. The structure cable as claimed in claim 32, wherein the guide member comprises a body of cast plastic resin around a metal reinforcements tube.

43. The structure cable as claimed in claim 42, wherein the plastic resin is a polyurethane resin.

44. A civil engineering structure cable, comprising:

a set of traction reinforcements;

two devices for anchoring the reinforcements in two respective zones of the construction, the reinforcements being spaced apart from one another at the anchoring devices; means for deviating the reinforcements to cause the reinforcements to converge toward a running part of the cable into a substantially parallel bundle more compact than at the anchoring devices;

at least one guide member in closely set contact around the set of reinforcements in the portion of the cable where the reinforcements converge toward the running part, said guide member having an inner surface presenting a cross section adapted to a peripheral shape of the parallel bundle and a longitudinal section having a convex curvature whereby, over the length of the guide member, said convex curvature allows angular deflections of the reinforcements up to an angle substantially greater than a maximum angle of convergence of the reinforcements between the anchoring device and the running part of the cable;

a tube connected to the structure of a part of the construction and having the reinforcements extending therethrough, one of the anchoring devices bearing longitudinally against said tube;

a damper arranged between the bundle of reinforcements and a support mounted at an end of said tube opposite said one of the anchoring devices, for damping transverse vibrations of the bundle of reinforcements with respect to the anchoring device; and wherein the guide member is placed on the set of reinforcements between the damper and said anchoring device, wherein the guide member is mounted with a limited capacity for transverse movement with respect to said anchoring device, so as to provide a defined stroke of the damper, wherein said support is mounted at the end of the tube by means of a connection designed to break when subjected to a force exceeding a predefined threshold.

45. A civil engineering structure cable, comprising:

a set of traction reinforcements;

two devices for anchoring the reinforcements in two respective zones of the construction, the reinforcements being spaced apart from one another at the anchoring devices; means for deviating the reinforcements to cause the reinforcements to converge toward a running part of the cable into a substantially parallel bundle more compact than at the anchoring devices; and at least one guide member in closely set contact around the set of reinforcements in the portion of the cable where the reinforcements converge toward the running part, said guide member having an inner surface presenting a cross section adapted to a peripheral shape of the parallel bundle and a longitudinal section having a convex curvature whereby, over the length of the guide member, said convex curvature allows angular defections of the reinforcements up to an angle substantially greater than a maximum angle of convergence of the reinforcements between the anchoring device and the running part of the cable, wherein the guide member comprises a body of cast plastic resin around a metal reinforcing tube.

46. The structure cable as claimed in claim 45, wherein the guide member is mounted with a capacity for transverse movement with respect to one of the anchoring devices.

47. The structure cable as claimed in claim 45, further comprising means for damping transverse vibrations of the bundle of reinforcements with respect to one of the anchoring devices, and wherein the guide member is placed on the set of reinforcements between the damping means and said anchoring device.

48. The structure cable as claimed in claim 45, wherein the deviation means comprise a collar clamped around the set of reinforcements at a distance from an anchoring device, and wherein the guide member is placed on the set of reinforcements between said collar and said anchoring device.

49. The structure cable as claimed in claim 48, wherein inserts are seated, together with the reinforcements, in the guide member, so as to maintain a spacing between the reinforcements inside the guide member.

50. The structure cable as claimed in claim 45, wherein the guide member belongs to the deviation means and contribute to causing the reinforcements to converge toward the running part of the cable.

51. The structure cable as claimed in claim 45, wherein the plastic resin is a polyurethane resin.

* * * * *